US012196198B2

(12) United States Patent
Cho et al.

(10) Patent No.: US 12,196,198 B2
(45) Date of Patent: Jan. 14, 2025

(54) RECIPROCATING COMPRESSOR

(71) Applicant: LG Electronics Inc., Seoul (KR)

(72) Inventors: Jaeho Cho, Seoul (KR); Sukang Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 45 days.

(21) Appl. No.: 17/471,773

(22) Filed: Sep. 10, 2021

(65) Prior Publication Data

US 2022/0235759 A1 Jul. 28, 2022

(30) Foreign Application Priority Data

Jan. 22, 2021 (KR) ..... 10-2021-0009619

(51) Int. Cl.
*F04B 53/00* (2006.01)
*F04B 39/00* (2006.01)
*F04B 53/16* (2006.01)

(52) U.S. Cl.
CPC ..... *F04B 53/001* (2013.01); *F04B 39/0066* (2013.01); *F04B 53/16* (2013.01)

(58) Field of Classification Search
CPC ..... F04B 39/0038; F04B 39/0061; F04B 39/0055; F04B 39/0027; F04B 53/16; F04B 53/0001; F04B 39/0066; F01N 1/023
USPC ..... 417/312
See application file for complete search history.

(56) References Cited

U.S. PATENT DOCUMENTS

2006/0275158 A1* 12/2006 Nagao ..... F04B 39/0061 417/415
2012/0292128 A1* 11/2012 Keesser ..... F01N 13/14 181/227
2016/0131123 A1* 5/2016 Kim ..... F04B 39/123 417/312

FOREIGN PATENT DOCUMENTS

| | | | | |
|---|---|---|---|---|
| CN | 1629476 | | 6/2005 | |
| CN | 101589231 | | 11/2009 | |
| CN | 101970877 | | 2/2011 | |
| CN | 105587554 | | 5/2016 | |
| CN | 105587554 | A * | 5/2016 | ..... F04B 39/0027 |
| JP | 2007205275 | | 8/2007 | |
| KR | 20050025500 | | 3/2005 | |
| KR | 10-2006-0118904 | | 11/2006 | |
| KR | 100641122 | | 11/2006 | |
| KR | 20070073511 | | 7/2007 | |
| KR | 20140060144 | | 5/2014 | |
| KR | 20160055498 | | 5/2016 | |
| KR | 1020160055497 | | 5/2016 | |

OTHER PUBLICATIONS

Extended European Search Report in European Appln. No. 21196514.0, dated Jan. 28, 2022, 4 pages.
Office Action in Korean Appln. No. 10-2021-0009619, dated May 23, 2022, 12 pages (with English translation).
Office Action in Chinese Appln. No. 202111175264.7, mailed on Mar. 23, 2023, 22 pages (with English translation).

* cited by examiner

*Primary Examiner* — Philip E Stimpert
(74) *Attorney, Agent, or Firm* — Fish & Richardson P.C.

(57) ABSTRACT

A reciprocating compressor includes a suction muffler including a partition wall that partitions an inner space of the suction muffler into multiple spaces. The suction muffler further includes a guide pipe that is provided at the partition (Continued)

wall and that defines a resonance hole configured to reduce noise in a specific band.

20 Claims, 15 Drawing Sheets

RECIPROCATING COMPRESSOR

CROSS-REFERENCE TO RELATED APPLICATIONS

The present application claims priority under 35 U.S.C. 119 and 35 U.S.C. 365 to Korean Patent Application No. 10-2021-0009619, filed on Jan. 22, 2021, which is hereby incorporated by reference in its entirety.

TECHNICAL FIELD

The present disclosure relates to a reciprocating compressor.

BACKGROUND

A reciprocating compressor is an apparatus that can compress a fluid in a manner of suctioning, compressing, and discharging refrigerant, as a piston reciprocates in a cylinder. The reciprocating compressor may be classified into a connection type reciprocating compressor and a vibration type reciprocating compressor depending on driving manners of a piston. For example, the connection type reciprocating compressor may compress refrigerant by reciprocation of a piston that is connected with a rotating shaft of a driving unit through a connecting rod. The vibration type reciprocating compressor may compress refrigerant by reciprocation of a piston that is connected with a mover of a reciprocating motor configured to vibrate.

In some cases, the connection type reciprocating compressor may include a housing shell having an enclosed space, a driving unit provided in the housing shell to provide driving force, a compressing unit connected with a rotating shaft of the driving unit to compress a refrigerant through a reciprocating motion of the piston in the cylinder using the driving force received from the driving unit, and a suction and discharge unit to suction the refrigerant and to discharge the refrigerant compressed through the reciprocating motion of the compressing unit.

The suction and discharge unit may include a valve assembly for opening or closing the suction space and the discharge space for the refrigerant, and a suction muffler and a discharge muffler that may reduce noise caused in the procedure of opening or closing the valve assembly.

In some cases, the reciprocating compressor may generate noise in a specific band, particularly, in a cavity resonant frequency band of the refrigerant. For example, the cavity may be defined inside the housing shell of the compressor.

In some cases, without a unit for reducing the noise generated in the specific band, overall noise of electric appliances, including the reciprocating compressor, may increase.

In some cases, the reciprocating compressor may be applied to a small-sized home appliance such as a water purifier. The noise caused by the small-sized home appliance may degrade reliability for the product.

SUMMARY

The present application describes a reciprocating compressor including a muffler assembly having a resonance chamber.

The present application also describes a reciprocating compressor including a suction muffler having an inner space divided into two spaces to reduce noise.

The present application also describes a reciprocating compressor including a partition wall installed in a suction muffler to divide an inner space into a resonance chamber and a cavity chamber, where the partition wall is stably supported on an inner surface of the suction muffler.

The present application also describes a reciprocating compressor including a guide pipe that communicates with a suction hole of a suction muffler and that is disposed at a partition wall to guide a refrigerant from a first space to a second space in the suction muffler.

The present application also describes a reciprocating compressor including a suction pipe portion that extends from a suction hole to a guide pipe and that is configured to transfer a refrigerant suctioned through the suction hole to the guide pipe.

The present application also describes a reciprocating compressor having a support structure for a guide pipe and a suction pipe portion to facilitate an assembly of the guide pipe and the suction pipe portion and to allow the guide pipe to be stably supported on a suction pipe portion during suction of a refrigerant.

The present application also describes a reciprocating compressor including a protrusion that is disposed on a partition wall to allow a guide pipe to be stably supported on a suction muffler.

The present application also describes a reciprocating compressor having a through-hole (resonance hole) that is defined in a guide pipe to reduce noise generated in the compressor.

According to one aspect of the subjected matter described in this application, a reciprocating compressor includes a partition wall that partitions an inside of a suction muffler into two spaces and a guide pipe that is provided in the partition wall and that defines a resonance hole to reduce noise in a specific band. For example, the reciprocating compressor can be installed in a small-sized product such as a water purifier, and the specific band can range of about 800 Hz to about 1 kHz. The two spaces can include a resonance chamber that is defined close to a suction hole of the suction muffler and a cavity chamber defined at an opposite side of the resonance chamber with respect to the partition wall.

The guide pipe can include a first part disposed in the resonance chamber and a second part disposed in the cavity chamber.

The guide pipe can include a through-hole defined as a resonance hole.

For example, the through-hole can be defined in the first part.

A protrusion can be disposed on the partition wall to allow the guide pipe to be stably supported on an inner surface of the suction muffler. For example, the protrusion can be supported on a support jaw provided on the inner surface of the suction muffler.

The suction muffler can include first and second muffler portions assembled together. The protrusion can be pressed by the first muffler, the partition wall can be stably supported.

The guide pipe can be supported by the suction pipe portion of the suction muffler and include a first end for introducing a refrigerant and a second end for discharging the refrigerant. Since the first end is seated on or inserted into the suction pipe, the guide pipe can be stably supported on the suction muffler.

According to one aspect of the subject matter described in this application, a reciprocating compressor includes a cylinder and a suction muffler that is configured to receive refrigerant and to supply the refrigerant to the cylinder. The suction muffler includes a suction muffler body that defines a suction space configured to receive the refrigerant, a partition wall that is disposed at the suction muffler body and partitions the suction space into a first space and a second space, and a guide pipe that is disposed at the partition wall and defines a refrigerant passage in fluid communication with the first and second spaces. The guide pipe includes (i) a first pipe portion that extends from the partition wall to the first space and defines a resonance hole and (ii) a second pipe portion that extends from the partition wall to the second space.

Implementations according to this aspect can include one or more of the following features. For example, the suction muffler body can define a suction hole configured to receive the refrigerant into the suction muffler, and the suction muffler can further include a suction pipe portion that is disposed inside the suction muffler body and that extends from the suction hole, where the suction pipe portion is in fluid communication with the first pipe portion. In some examples, the suction hole can be defined at an outer surface of the suction muffler body, and the suction pipe portion can extend from the suction hole to a central portion of the suction muffler body.

In some implementations, the suction pipe portion can include (i) a pipe discharge portion configured to discharge the refrigerant in the suction pipe portion to the guide pipe and (ii) a support stepwise portion that protrudes inward from an inner circumferential surface of the pipe discharge portion and supports an end of the first pipe portion.

In some implementations, the guide pipe can extend from the first space to the second space in a direction crossing the partition wall. In some examples, the guide pipe can extend from the first space to the second space through the partition wall. In some examples, the first pipe portion can have a first end configured to introduce the refrigerant in the first space into the guide pipe, and the second pipe portion can have a second end configured to discharge the refrigerant to the second space. In some examples, a length of the second pipe portion can be greater than a length of the first pipe portion.

In some implementations, the partition wall can include a partition wall plate connected to the guide pipe and a protrusion that protrudes from the partition wall plate and is in contact with an inner surface of the suction muffler body, where the suction muffler body includes a support jaw that supports the partition wall plate. In some examples, the suction muffler body can include a first suction muffler body and a second suction muffler body, where the partition wall plate is disposed within the second suction muffler body. In some examples, an inner surface of the second suction muffler body supports the protrusion of the partition wall, and an end of the first suction muffler body is configured to apply pressure to the protrusion of the partition wall.

In some implementations, the first suction muffler body can include a flange and an inner wall that are spaced apart from each other to thereby define an insertion space therebetween, where the insertion space receives an end of the second suction muffler body. In some examples, the inner wall of the first suction muffler body can be configured to apply pressure to the protrusion of the partition wall. In some examples, the first space includes a resonance chamber, and the second space includes a cavity chamber, where the resonance chamber and the cavity chamber are configured to reduce noise generated in the reciprocating compressor.

In some implementations, the reciprocating compressor includes a tank disposed between the cylinder and the suction muffler and configured to receive the refrigerant from the suction muffler and to discharge the refrigerant to the cylinder, and a discharge muffler disposed at a side of the tank and configured to receive the refrigerant compressed in the cylinder and to discharge the refrigerant to an outside of the discharge muffler. In some examples, the tank is disposed between the suction muffler and the discharge muffler and connects the suction muffler and the discharge muffler to each other.

In some implementations, the refrigerant passage can extend from a first end of the first pipe portion facing away from the tank to a second end of the second pipe portion facing the tank, where a distance between the partition wall and the first end of the first pipe portion is less than a distance between the partition wall and the second end of the second pipe portion.

In some implementations, the partition wall can be disposed inside the suction muffler body. In some examples, the refrigerant passage can extend from a first end hole defined at the first pipe portion to a second end hole defined at the second pipe portion, where each of the resonance hole and the first end hole is configured to supply the refrigerant in the first space to the second space through the refrigerant passage.

In some implementations, the resonance hole can pass through a circumferential surface of the first pipe portion and be in fluid communication with the refrigerant passage inside the first pipe portion.

The details of one or more implementations are set forth in the accompanying drawings and the description below. Other features will be apparent from the description and drawings, and from the claims.

DETAILED DESCRIPTION

Hereinafter, exemplary implementations of the present disclosure will be described in detail with reference to accompanying drawings, such that those skilled in the art can more apparently understand the present disclosure. It should be understood that the exemplary implementations herein are provided only for the illustrative purpose, and various modifications of the implementations are reproduced. In addition, the shapes and the sizes of elements in accompanying drawings may be exaggerated for more apparent description.

Figure 1:
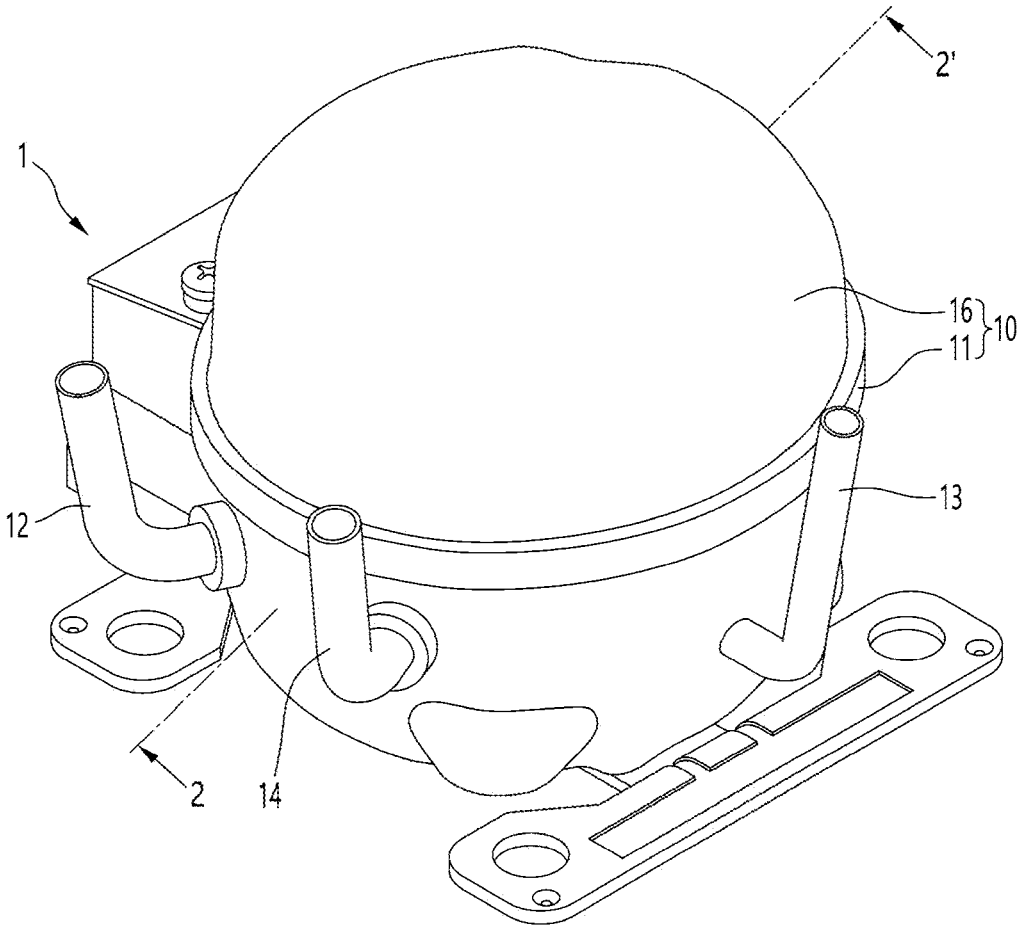
FIG. 1 is a perspective view illustrating an example of a reciprocating compressor.
Figure 2:
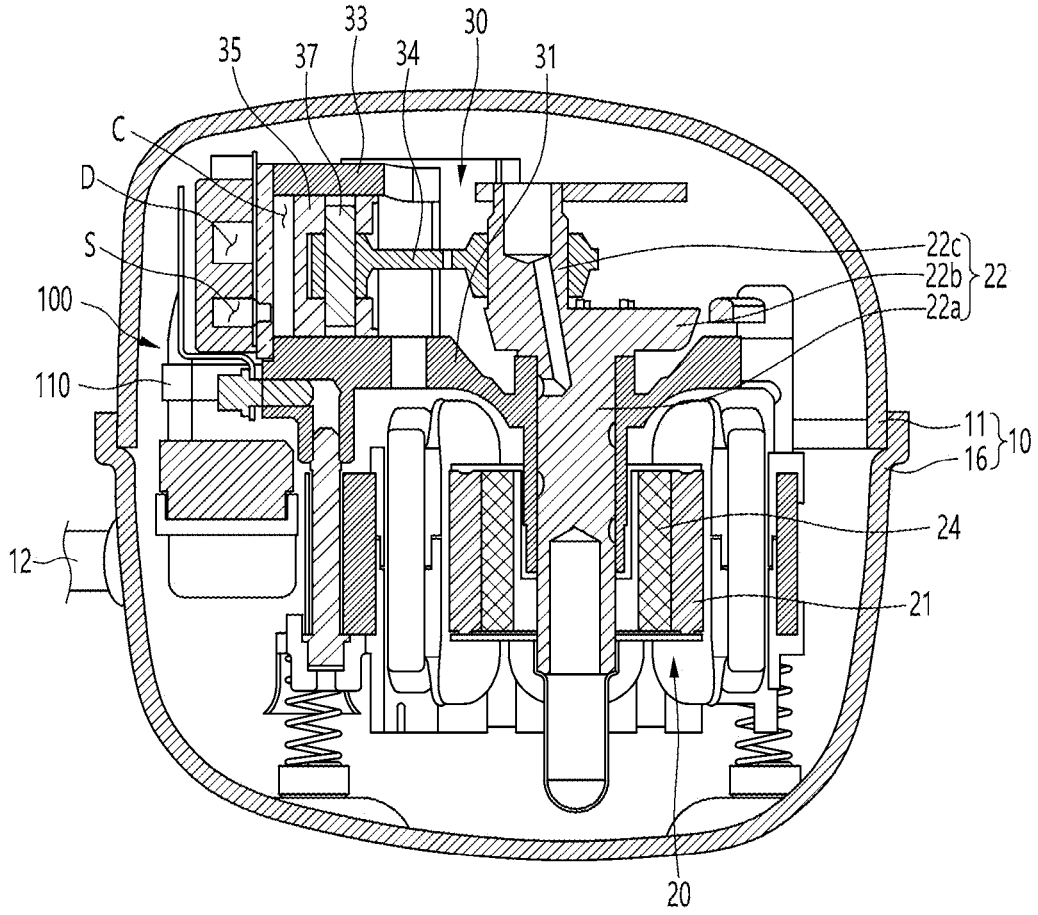
FIG. 2 is a cross-sectional view taken along line 2-2' of FIG. 1.

FIG. 1 is a perspective view illustrating an example of a reciprocating compressor, and FIG. 2 is a cross-sectional view taken along line 2-2' of FIG. 1.

Referring to FIGS. 1 and 2, a reciprocating compressor 1 can include a shell 10 that defines an outer appearance of the reciprocating compressor 1. An enclosed space can be defined inside the shell 10, and various components of the reciprocating compressor 1 can be received in the enclosed space. The shell 10 can be made of a metallic material.

A cavity can be formed in an inner space of the shell 10 to define the resonance frequency of the refrigerant. In some implementations, a structure of reducing noise caused in a cavity resonance frequency band of the refrigerant can be provided.

In some implementations, the shell 10 can include a lower shell 11 and an upper shell 16 provided at an upper side of the lower shell 11. For example, the lower shell 11 can have a substantially hemispherical shape and define a receiving space to receive various components, for example, such as a driving unit 20, a compressing unit 30, and a suction and discharge unit 100, together with the upper shell 16. In some examples, the lower shell 11 can be referred to as a "compressor body" and the upper shell 16 can be referred to as a "compressor cover."

The lower shell 11 includes a suction pipe 12, a discharge pipe 13, a process pipe 14, and a power supply. The suction pipe 12 is used to introduce a refrigerant into the shell 10, and is mounted through the lower shell 11. The suction pipe 12 can be mounted separately from the lower shell 11 or can be integrally formed with the lower shell 11.

The discharge pipe 13 is used to discharge the refrigerant, which is compressed in the shell 10, and is mounted through the lower shell 11. The discharge pipe 13 can be separately mounted separately from the lower shell 11 or can be integrally formed with the lower shell 11.

A discharge hose 60 (see FIG. 3) is connected with the discharge pipe 13. The refrigerant, which is introduced into the suction pipe 12 and compressed by the compressing unit 30, can be discharged to the discharge pipe 13 through the suction and discharge unit 100 and the discharge hose 60.

The process pipe 14, which is a device provided to fill the refrigerant into the shell 10 after the inner portion of the shell 10 is sealed, can be mounted through the lower shell 11.

The driving unit 20 is provided in the inner space of the shell 10 to provide driving force. The driving unit 20 can include a stator 21, a rotor 24, and a rotating shaft 22. The stator 21 includes a stator core and a coil coupled to the stator core. The driving unit 20 can be a driver such as an electric motor.

When power is applied to the coil, the coil generates electromagnetic force to perform electromagnetic interaction with the stator core and the rotor. Accordingly, the driving unit 20 can generate driving force for a reciprocating motion of the compressing unit 30.

The rotor 24 has a magnet, and is rotatably provided inside the coil. The rotational force resulting from the rotation of the rotor 24 acts as driving force for driving the compressing unit 20.

The rotating shaft 22 can rotate together with the rotor 24, and can be mounted through an inner portion of the rotor 24 in a vertical direction. In addition, the rotating shaft 22 is connected to a connecting rod 34 to transmit the rotational force generated by the rotor 24 to the compressing unit 30.

In detail, the rotating shaft 22 can include a base shaft 22*a*, a rotational plate 22*b*, and an eccentric shaft 22*c*.

The base shaft 22*a* is mounted inside the rotor 24 in the vertical direction. When the rotor 24 rotates, the base shaft 22*a* can be rotated together with the rotor 24. The rotational plate 22*b* can be installed on one side of the base shaft 22*a*, and can be rotatably mounted to a cylinder block 31 to be described later.

The eccentric shaft 22*c* protrudes upward from a position eccentric from the axial center of the base shaft 22*a* to eccentrically rotate when the rotational plate 22*b* rotates. A connecting rod 34 is mounted on the eccentric shaft 22*c*. As the eccentric shaft 22*c* eccentrically rotates, the connecting rod 34 can linearly reciprocate in a front-rear direction.

The compressing unit 30 receives the driving force from the driving unit 20 to compress the refrigerant through linear reciprocation motion. The compressing unit 30 can include a cylinder block 31, a connecting rod 34, a piston 35, and a piston pin 37.

The cylinder block 31 is provided above the rotor 24. In addition, the cylinder block 31 has a shaft opening such that the rotating shaft 22 passes through the shaft opening. A lower portion of the cylinder block 31 can rotatably support the rotational plate 22*b*.

The cylinder 33 is provided at a front portion of the cylinder block 31 and arranged to receive the piston 35. The piston 35 reciprocates in the front-rear direction, and a compressing space C for compressing the refrigerant is formed inside the cylinder 33.

The connecting rod 34 is a device for transmitting the driving force, which is provided from the driving unit 20, to the piston 35, and converts the rotational motion of the rotating shaft 22 into the linear reciprocation motion. In detail, the connecting rod 34 linearly reciprocates in the front-rear direction when the rotating shaft 22 rotates.

The piston 35 is a device for compressing the refrigerant, and is provided in the cylinder 33. The piston 35 is connected with the connecting rod 34 and linearly reciprocates in the cylinder 33, as the connecting rod 34 moves. The refrigerant introduced from the suction pipe 12 can be compressed in the cylinder 33, as the piston 35 linearly reciprocates.

The piston pin 37 couples the piston 35 and the connecting rod 34. In detail, the piston pin 37 can connect the piston 35 with the connecting rod 34 by passing through the piston 35 and the connecting rod 34 in the vertical direction.

The suction and discharge unit 100 is configured to suction the refrigerant to be supplied to the compressing unit 30 and to discharge the compressed refrigerant from the compressing unit 30. The suction and discharge unit 100 can include a muffler assembly 110 and a discharge hose (or hose assembly) 60.

The muffler assembly 110 transfers the suctioned refrigerant, which is received from the suction pipe 12, into the cylinder 33, and transfers the refrigerant, which is compressed in the compressing space C of the cylinder 33, to the discharge pipe 13. To this end, the muffler assembly 110 has a suction space S for receiving the suctioned refrigerant from the suction pipe 12 and a discharge space D for receiving the refrigerant compressed in the compressing space C of the cylinder 33.

In detail, the suctioned refrigerant from the suction pipe 12 can be introduced into the suction space S of a suction and discharge tank 120 through suction muffler portions 130 and 140. The refrigerant compressed in the cylinder 33 passes through discharge muffler portions 150 and 160 through the discharge space D of the suction and discharge tank 120, and is discharged of the compressor 1 through the discharge hose 60 and the discharge pipe 13.

The discharge hose 60 is a device to transfer the compressed refrigerant, which is contained in the discharge space D, to the discharge pipe 13, and is integrally formed with a second discharge muffler portion 160 of the discharge muffler portions 150 and 160. In detail, one portion of the discharge hose 60 can be coupled to the second discharge muffler portion 160 to communicate with the discharge space D, or can be formed integrally with the second discharge muffler portion 160.

An opposite portion of the discharge hose 60 is coupled to the discharge pipe 13 through a connector 65. The discharge hose 60 and the connector 65 can be jointed to each other or can be formed integrally with each other.

The connector 65 has a plurality of grooves, and ring members 66*a* and 66*b* can be installed in the plurality of grooves, respectively. The ring members 66*a* and 66*b* can be formed of rubber or synthetic resin material.

Figure 3:
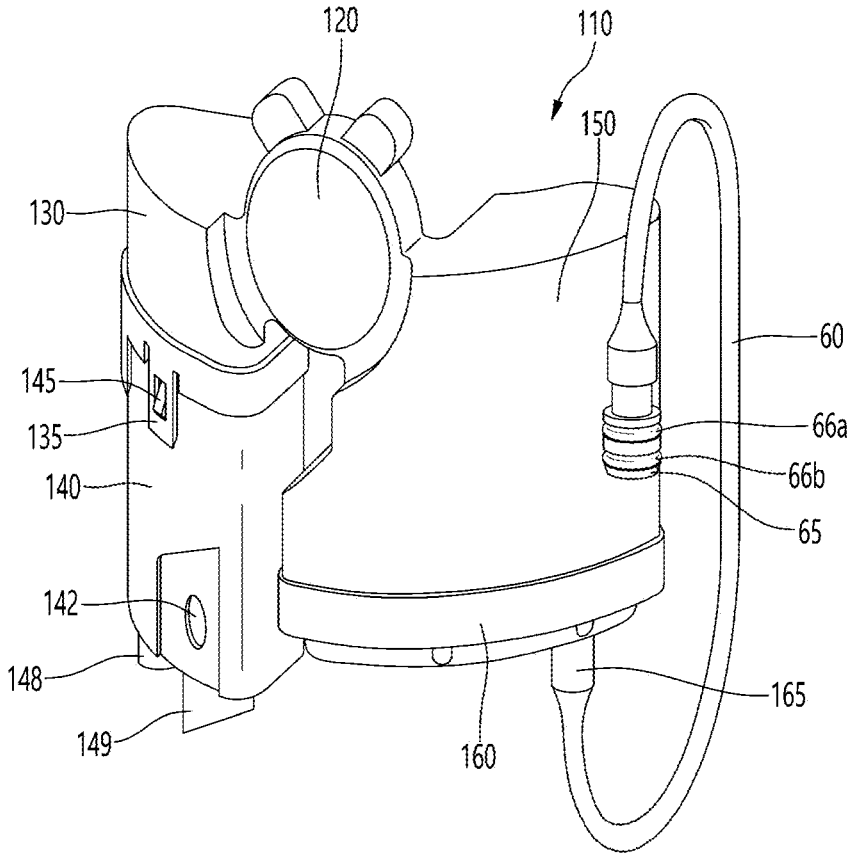
FIG. 3 is a perspective view illustrating an example of a muffler assembly.
Figure 4:
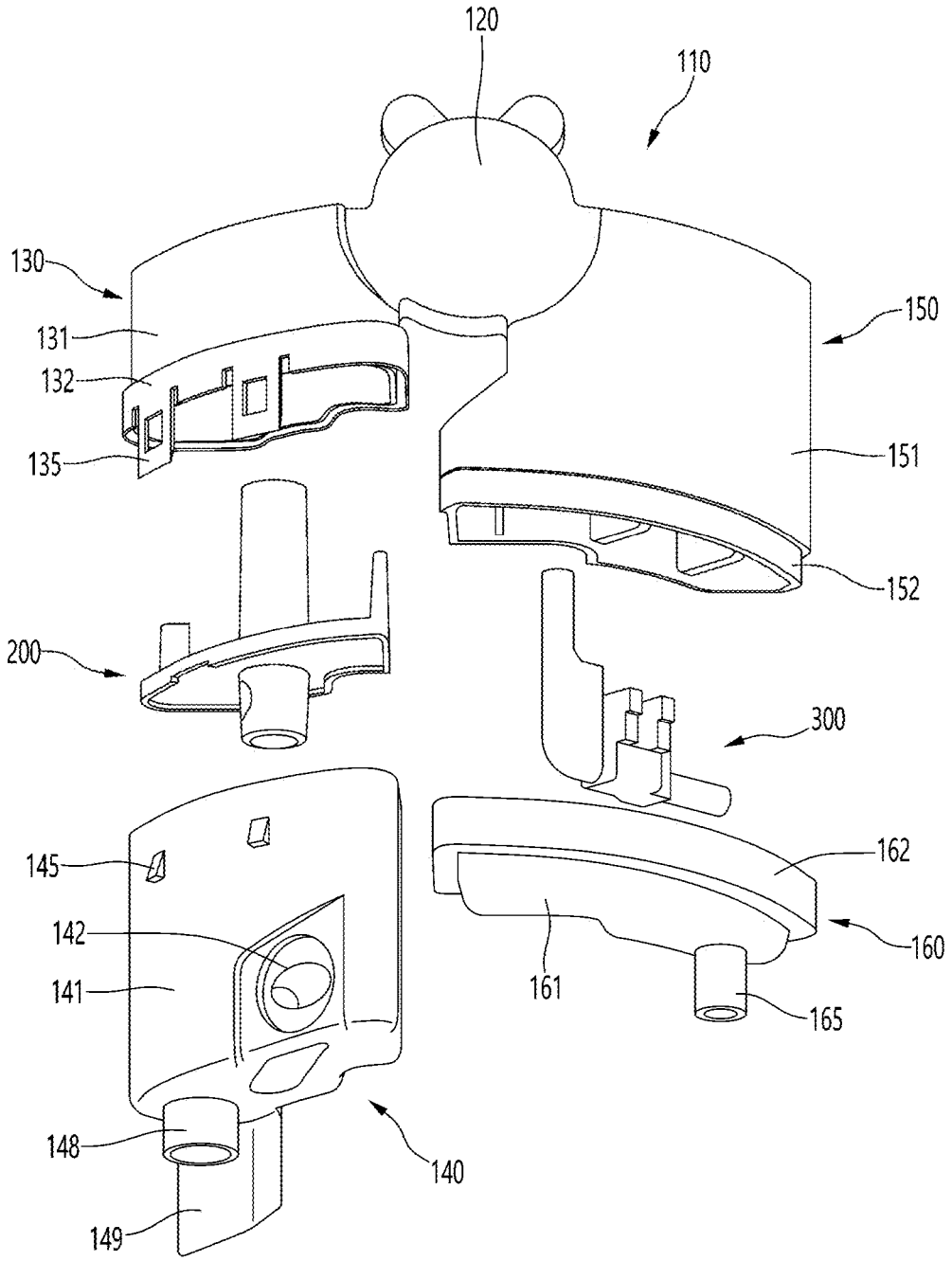
FIG. 4 is a front exploded perspective view illustrating the muffler assembly.
Figure 5:
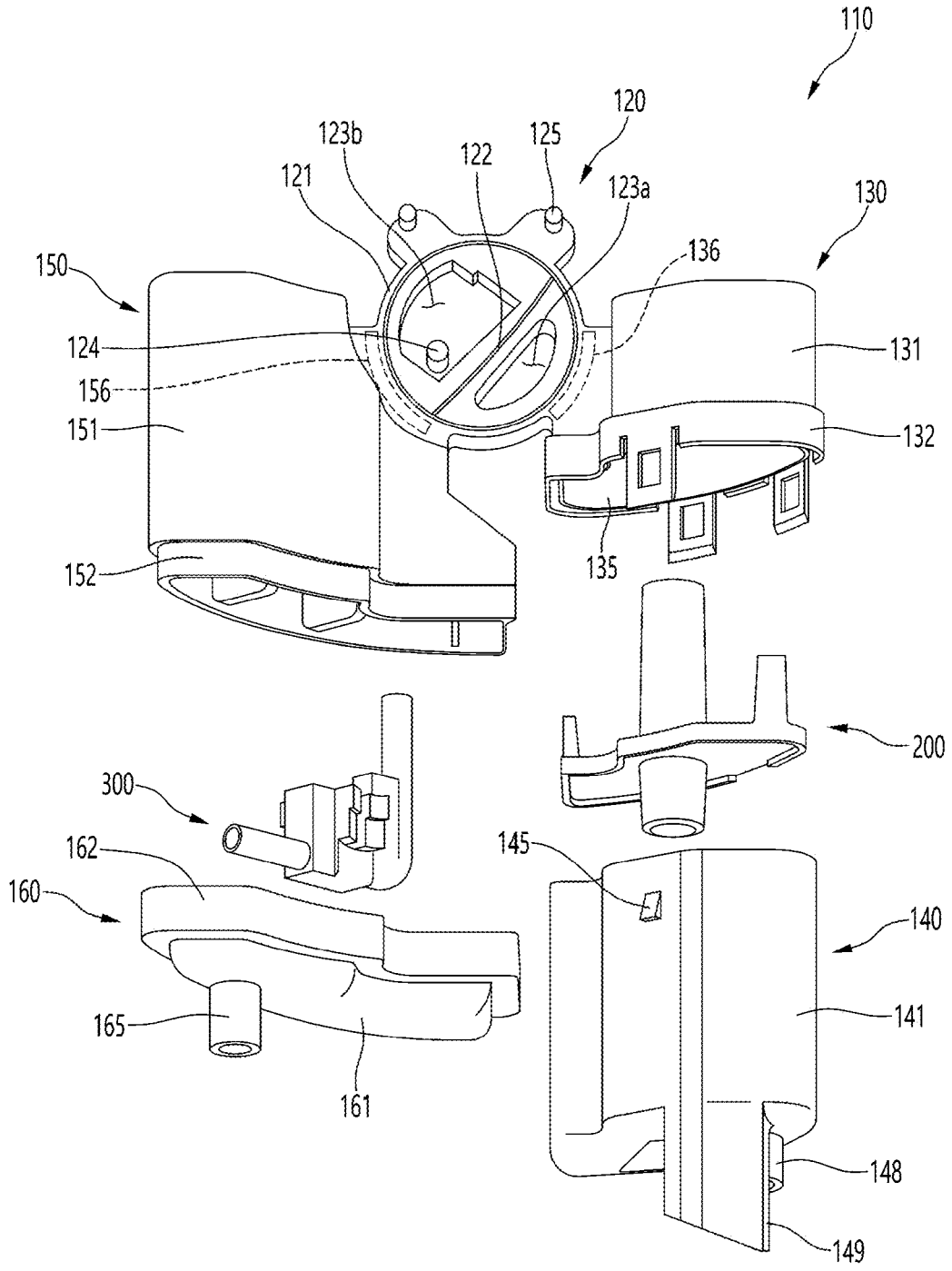
FIG. 5 is a rear exploded perspective view illustrating the muffler assembly.

FIG. 3 is a perspective view illustrating an example configuration of the muffler assembly, FIG. 4 is a front exploded perspective view illustrating the muffler assembly, and FIG. 5 is a rear exploded perspective view illustrating the muffler assembly.

Referring to FIGS. 3 to 5, the muffler assembly 110 can include a first suction muffler portion 130 and a second suction muffler portion 140 constituting the suction muffler.

The first suction muffler portion 130 and the second suction muffler portion 140 can be assembled, and a refrigerant suction space (or a suction fluid passage) can be defined inside the first and second suction muffler portions 130 and 140 through the assembling between the first suction muffler portion 130 and the second suction muffler portion 140.

When viewed based on FIG. 3, the first suction muffler portion 130 can be coupled to an upper side of the second suction muffler portion 140. For example, the first suction muffler portion 130 can include a hook 135, and the second suction muffler portion 140 can include a hook protrusion 145 coupled to the hook 135.

Unlike the drawings, the hook protrusion can be provided on the first suction muffler portion 130, and the hook coupled to the hook protrusion can be provided on the second suction muffler portion 140.

The first suction muffler portion 130 can include a first muffler body 131 including a suction guide hole 136. An end of the first muffler body 131 can be open.

A first muffler flange 132 coupled to the second suction muffler portion 140 can be provided on the first muffler body 131. The first muffler flange 132 can be formed to be stepped from the first muffler body 131 such that an outer diameter of the first muffler flange 132 is greater than an outer diameter of the first muffler body 131.

The first muffler flange 132 can be coupled to an open end of the second discharge muffler portion 160. For example, the first muffler flange 132 can be coupled to an outer portion of the second discharge muffler portion 160.

The second suction muffler portion 140 can include a second muffler body 141 having a suction hole 142 communicating with the suction pipe 12.

The combination of the first muffler body 131 of the first suction muffler portion 130 and the second muffler body 141 of the second suction muffler portion 140 can be collectively referred to as a "suction muffler body."

The suction hole 142 can be formed through a portion of an outer circumferential surface of the second muffler body 141. In addition, the suction hole 142 is positioned adjacent to the inside of one point of the lower shell 11 to which the suction pipe 12 is coupled.

The second suction muffler portion 140 can include an oil drain portion 148 such that oil separated from the refrigerant in the inner space of the suction muffler portions 130 and 140 is discharged into the inner space of the shell 10. The oil drain portion 148 can protrude downward from a bottom surface of the second muffler body 141.

The second suction muffler portion 140 can further include a skirt 149 protruding downward from the bottom surface of the second muffler body 141 to prevent the oil discharged from the oil drain portion 148 from scattering. The skirt 149 can be provided adjacent to the oil drain portion 148.

A suction pipe portion 143 (see FIG. 7) is provided in the second suction muffler portion 140. The suction pipe portion 143 can extend from the suction hole 142 in a central direction of the inside of the second suction muffler portion 140. The suction pipe portion 143 can be configured as, for example, a pipe having a cylindrical shape.

The suction and discharge tank 120 is connected to one side of the first suction muffler portion 130. For example, the first suction muffler portion 130 and the suction and discharge tank 120 can be integrally formed.

The discharge muffler portions 150 and 160 can be provided in opposition to each other based on the suction and discharge tank 120.

In detail, the first discharge muffler portion 150 of the discharge muffler is disposed to be spaced apart from one side of the first suction muffler portion 130. The suction and discharge tank 120 having the suction space S and the discharge space D are mounted between the first suction muffler portion 130 and the first discharge muffler portion 150.

The first suction muffler portion 130, the suction and discharge tank 120, and the first discharge muffler portion 150 can be integrally configured. The first suction muffler portion 130, the suction and discharge tank 120, and the first discharge muffler portion 150 can be collectively named a "tank assembly."

The first suction muffler portion 130, the suction and discharge tank 120, and the first discharge muffler portion 150 can be formed of the same material, for example, of a nylon material having higher pressure resistance.

The suction and discharge tank 120 can include a tank body 121 having a suction and discharge space. For example, the tank body 121 can have a cylindrical shape.

A suction chamber 123*a* and a discharge chamber 123*b* can be formed inside the tank body 121. The suction chamber 123*a* can have the suction space S, and the discharge chamber 123*b* can have the discharge space D.

The suction chamber 123*a* and the discharge chamber 123*b* can be formed to be recessed in a surface facing the valve assembly.

The suction chamber 123*a* can be configured to communicate with the suction guide hole 136 of the first suction muffler portion 130. The suction guide hole 136 can be formed in the connection portion between the suction and discharge tank 120 and the first suction muffler portion 130.

For example, the suction guide hole 136 can be formed in one side of an outer circumferential surface of the suction and discharge tank 120.

The discharge chamber 123*b* can be configured to communicate with the discharge guide hole 156 of the first discharge muffler portion 150. The discharge guide hole 156 can be formed in the connection portion between the suction and discharge tank 120 and the first discharge muffler portion 150. For example, the discharge guide hole 156 can be formed in an opposite side of an outer circumferential surface of the suction and discharge tank 120.

The suction and discharge tank 120 can include a partition portion 122 to partition the inner space of the suction and discharge tank 120 into the suction chamber 123*a* and the discharge chamber 123*b*. The valve assembly can be installed at one side of the suction and discharge tank 120. The valve assembly can include a suction valve to open and close the suction chamber 123*a* and a discharge valve to open and close the discharge chamber 123*b*.

A retainer 124 can be provided in the discharge chamber 133*b* to limit the opening amount of the discharge valve. The retainer 124 can protrude from the bottom surface of the discharge chamber 133*b* and be disposed adjacent to the discharge guide hole 156.

The suction and discharge tank 120 can further include a sealing protrusion 125 to which a sealing member is coupled.

The second discharge muffler portion 160 of the discharge muffler can be assembled with the first discharge muffler portion 150, and a discharge space (or a discharge fluid passage) for the refrigerant can be defined inside the first and second discharge muffler portions 150 and 160 through the assembling.

When viewed based on FIG. 3, the first discharge muffler portion 150 can be coupled to an upper side of the second discharge muffler portion 160.

The first discharge muffler portion 150 can include a first muffler body 151 including a discharge guide hole 156. An end of the first muffler body 151 can be open.

A first muffler flange 152 coupled to the second discharge muffler portion 160 can be provided on the first muffler body 151. The first muffler flange 152 can be formed to be stepped from the first muffler body 151 such that an outer diameter of the first muffler flange 132 is greater than an outer diameter of the first muffler body 151. The first muffler flange 152 can be inserted into an open end of the second discharge muffler portion 160.

The second discharge muffler portion 160 can include a second muffler body 161 having a discharge portion 165 coupled to the discharge hose 60.

A second muffler flange 162 coupled to the first discharge muffler portion 150 can be provided on an end of the second muffler body 161. The second muffler flange 162 can be formed to be stepped from the second muffler body 161 such that an outer diameter of the second muffler flange 162 is greater than an outer diameter of the second muffler body 161. The second muffler flange 162 can be coupled to an outer portion of the first muffler flange 152.

A discharge guide device 300 for reducing pressure pulsation of the discharged refrigerant can be provided inside the discharge muffler portions 150 and 160. The discharge guide device 300 can form the discharge fluid passage of the refrigerant, and can be supported by inner surfaces of the discharge muffler portions 150 and 160.

The discharge hose 60 can extend from the second discharge muffler portion 160 and be coupled to the discharge pipe 13. The discharge hose 60 can be coupled to the discharge portion 165.

Figure 6:
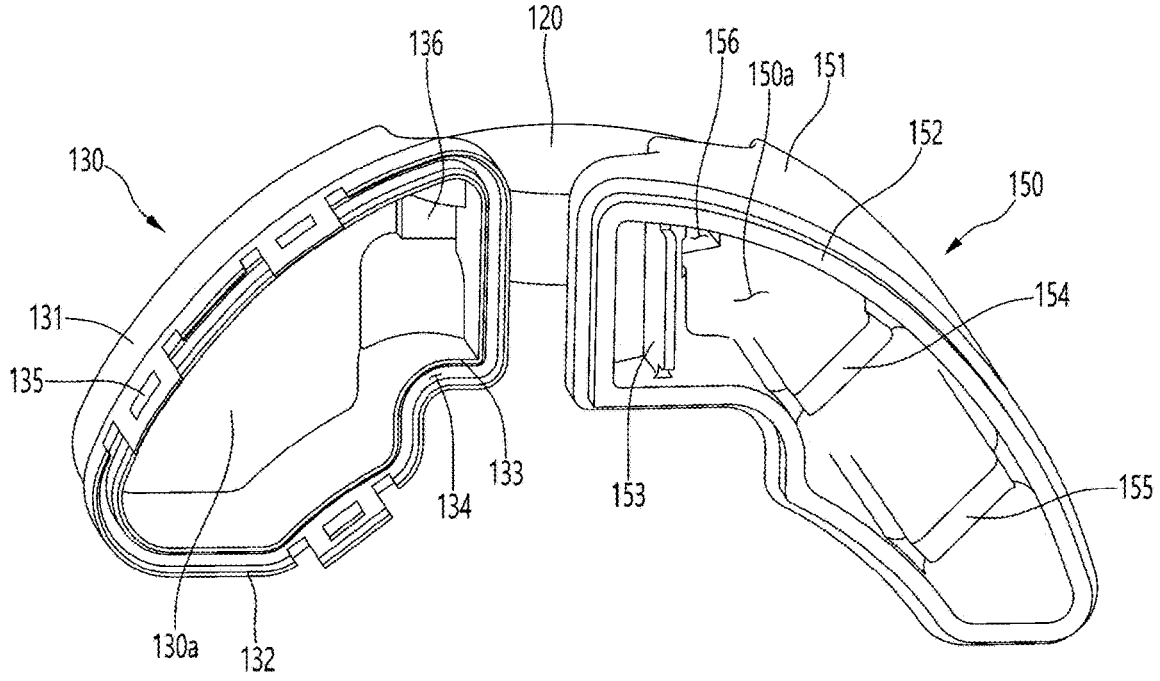
FIG. 6 is a view illustrating an example of a suction and discharge tank coupled to first and third muffler portions.
Figure 7:
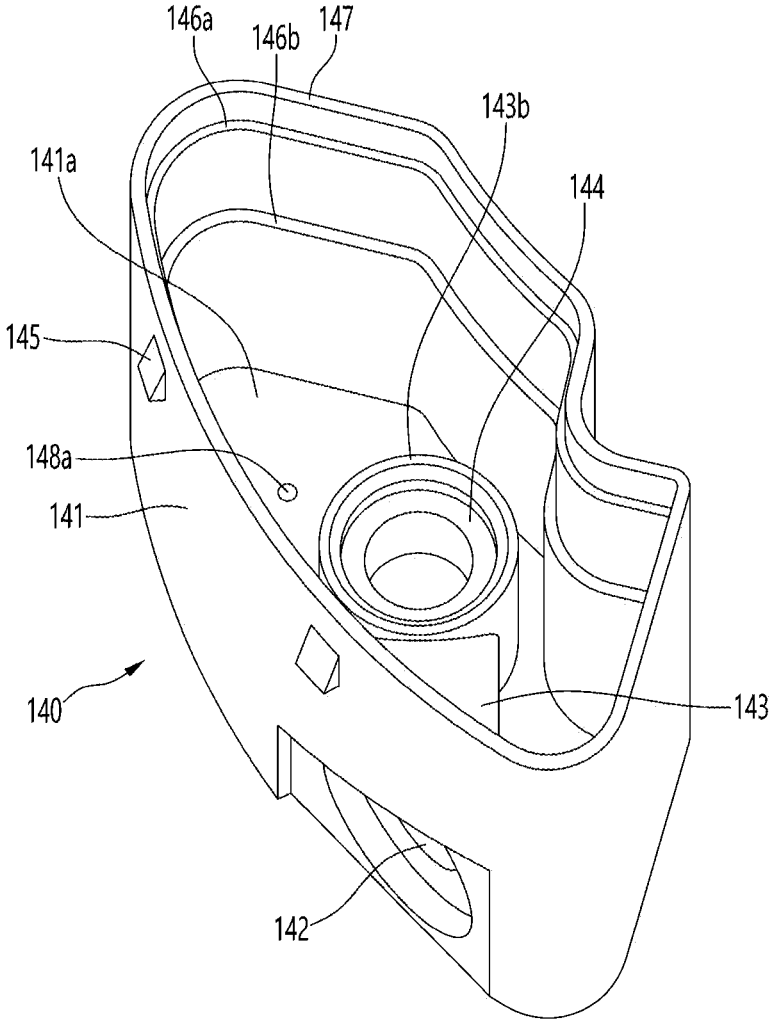
FIG. 7 is a view illustrating an example of a second suction muffler portion.

FIG. 6 is a view illustrating an example configuration of the suction and discharge tank that is integrated with the first and third muffler portions, and FIG. 7 is a view illustrating an example configuration of the second suction muffler portion.

Referring to FIGS. 6 and 7, the muffler assembly 110 can include the suction and discharge tank 120, the first suction muffler portion 130 provided at one side of the suction and discharge tank 120, and the first discharge muffler portion 150 provided at an opposite side of the suction and discharge tank 120.

The first suction muffler portion 130 and the first discharge muffler portion 150 can be disposed in opposition to each other based on the suction and discharge tank 120.

The first suction muffler portion 130 can include a first muffler body 131 to form a flowing space, that is, the suction fluid passage for the refrigerant which is suctioned into the muffler assembly 110. The suction guide hole 136, which is to suction the refrigerant into the suction and discharge tank 120, can be formed in the first muffler body 131. The suction guide hole 136 can be formed in a portion at which the first suction muffler portion 130 is connected with the suction and discharge tank 120.

The first suction muffler portion 130 can further include an inner wall 133 provided inside the first muffler body 131. The inner wall 133 can extend along an inner circumferential surface of the first muffler body 131 in parallel to the first muffler body 131.

The inner wall 133 can be spaced apart from the inner circumferential surface of the first muffler body 131. An insertion space 134 can be provided between the first muffler body 131 and the inner wall 133. An end of the second suction muffler portion 140 can be inserted into the insertion space 134, such that the first and second suction muffler portions 130 and 140 can be assembled.

The first discharge muffler portion 150 can include a first muffler body 151 that forms a flowing space, that is, a discharge fluid passage 150*a* for the refrigerant discharged from the suction and discharge tank 120. The discharge guide hole 156, which is to discharge the refrigerant from the suction and discharge tank 120, can be formed in the first muffler body 151. The discharge guide hole 156 can be formed in a portion at which the first discharge muffler portion 150 is connected with the suction and discharge tank 120.

The first discharge muffler portion 150 can include at least one wall provided in the discharge fluid passage 150*a* to divide the discharge fluid passage 150*a* into a plurality of discharge rooms. For example, the at least one wall can include a plurality of walls 153,154, and 155.

The plurality of walls 153, 154, and 155 can function as "reinforcing walls" that prevent the discharge muffler portions 150 and 160 from being damaged by the high pressure applied when the discharged refrigerant flows.

The plurality of walls 153, 154, and 155 can include a first wall 153, a second wall 154 spaced apart from one side of the first wall 153, and a third wall 155 spaced apart from an opposite side of the first wall 153.

The discharge chamber 123*b* of the suction and discharge tank 120 can form a primary discharge room for the refrigerant.

A space between the first wall 153 and the second wall 154 or a space between the first wall 153 and the first muffler body 151 can define a secondary discharge room of the refrigerant.

A space between the third wall 155 and the first muffler body 151 can define a tertiary discharge room for the refrigerant.

A space between the second wall 154 and the third wall 155 can define a quaternary discharge room of the refrigerant.

The discharge guide device 300 can be arranged to be positioned in the spaces among the plurality of walls 153, 154, and 155. A main stream of the refrigerant discharged to the first discharge muffler portion 150 through the discharge guide hole 156 passes through an inner fluid passage of the discharge guide device 300 and is discharged to the outside through the discharge portion 165 of the second discharge muffler portion 160.

In some implementations, a sub-stream of the refrigerant discharged to the first discharge muffler portion 150 through the discharge guide hole 156 can be diffused into the secondary discharge room to the quaternary discharge room. The discharge pulsation of the refrigerant can be reduced by the main stream and the sub-stream of the refrigerant.

A second suction muffler portion 140 can be assembled to the first suction muffler portion 130. The first suction muffler portion 130 and the second suction muffler portion 140 can be coupled to each other by ultrasonic welding.

The second suction muffler portion 140 can include a second muffler body 141 that defines a suction space for the refrigerant. An oil drain hole 148*a* through which oil is discharged can be defined in a bottom surface 141*a* of the second muffler body 141. The oil drain hole 148*a* can be defined at a position corresponding to the oil drain portion 148.

An assembly end 147 inserted into the insertion space 134 of the first suction muffler portion 130 can be disposed on the second muffler body 141. The assembly end 147 can be disposed on an upper end of the second muffler body 141.

The second suction muffler portion 140 can further include supporting jaws 146*a* and 146*b* to support the first suction muffler portion 130 or the suction guide device 200.

The supporting jaws 146*a* and 146*b* can be disposed to be stepped on an inner circumferential surface of the second muffler body 141.

The supporting jaws 146*a* and 146*b* can include a first supporting jaw 146*a* disposed below the assembly end 147 to support the first suction muffler portion 130. An end of the first suction muffler portion 130 can be disposed on the first support jaw 146*a*.

The end of the first suction muffler portion 130 can be placed on the protrusions 215*a* and 215*b* of the suction guide device 200, and when the first and second suction muffler portions 130 and 140 are assembled, the first suction muffler portion 130 can press upper ends of the protrusions 215*a* and 215*b*. Thus, the suction guide device 200 can be stably supported inside the first and second suction muffler portions 130 and 140.

The supporting jaws 146*a* and 146*b* can include a second supporting jaw 146*b* disposed below the first supporting jaw 146*a* to support the suction guide device 200.

The second support jaw 146*b* can be disposed to be further stopped from the first support jaw 146*a* in the inner direction of the second suction muffler portion 140. A partition wall 210 of the suction guide device 200 can be supported on the second support jaw 146*b*.

The second suction muffler portion 140 can include the suction hole 142 for introducing the refrigerant and the suction pipe portion 143 extending from the suction hole 142 to the inner space of the second suction muffler portion 140.

The suction pipe portion 143 includes a pipe inflow portion 143*a* having a first end connected to the suction hole 142 and a pipe discharge portion 143*b* having a second end connected to the suction guide device 200. The pipe inflow portion 143*a* can be disposed on an inner circumferential surface of the second muffler body 141, and the pipe discharge portion 143*b* can be disposed at a central portion of the inside of the second muffler body 141.

The suction guide device 200 can be supported on the suction pipe portion 143. A support stepwise portion 144 on which the end of the suction guide device 200 is supported can be provided inside the pipe discharge portion 143*b*. The guide pipe 220 of the suction guide device 200 can be supported on the support stepwise portion 144.

The support stepwise portion 144 can protrude from the inner circumferential surface of the suction pipe portion 143 by a predetermined length so that the first end 223 of the first pipe portion 221*a* of the guide pipe 220 is in surface contact with the support stepwise portion 144 and extends in a circumferential direction. Since the end of the first pipe portion 221*a* is seated on the support stepwise portion 144, the suction guide device 200 can be easily assembled with the second suction muffler portion 140.

Hereinafter, the suction guide device 200 will be described in more detail.

Figure 8:
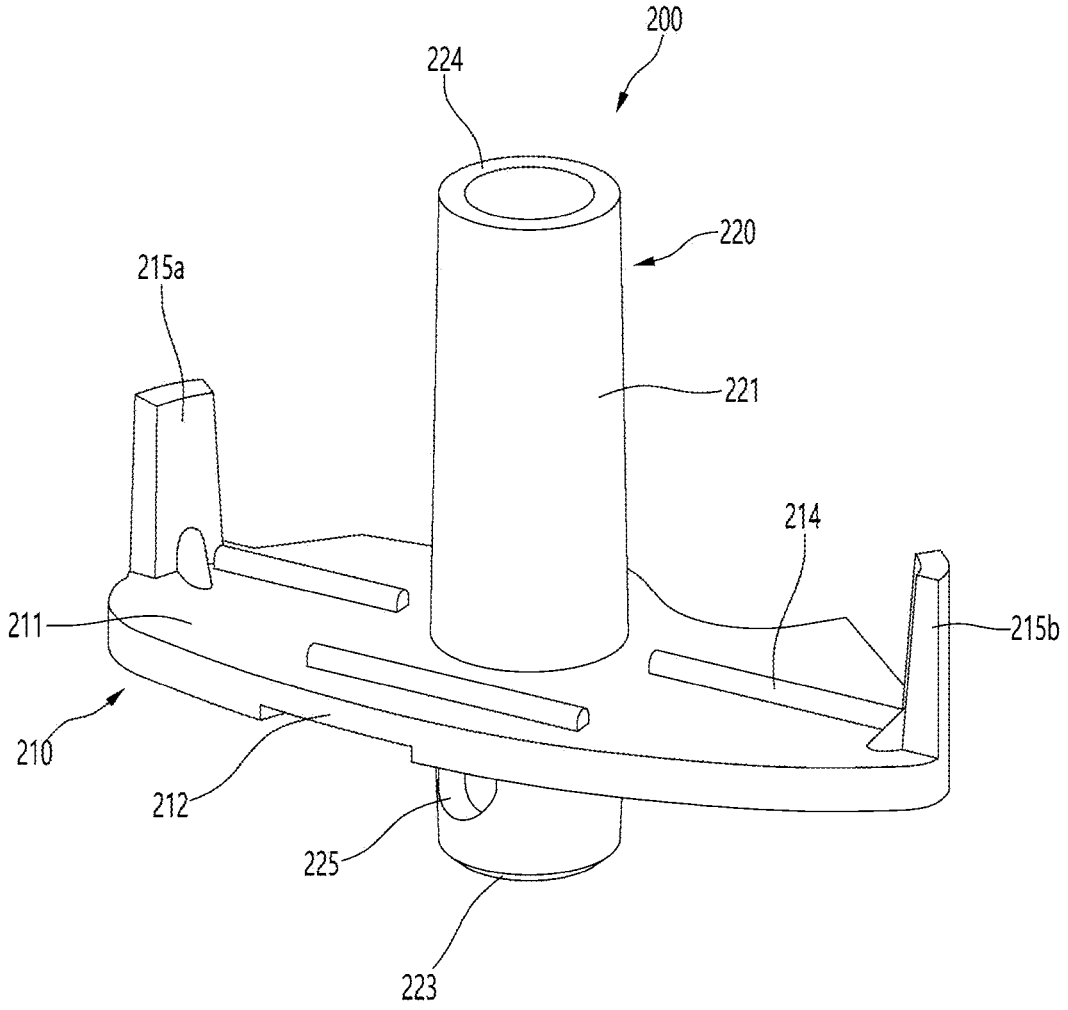
FIG. 8 is an upper perspective view illustrating an example of a suction guide device.
Figure 9:
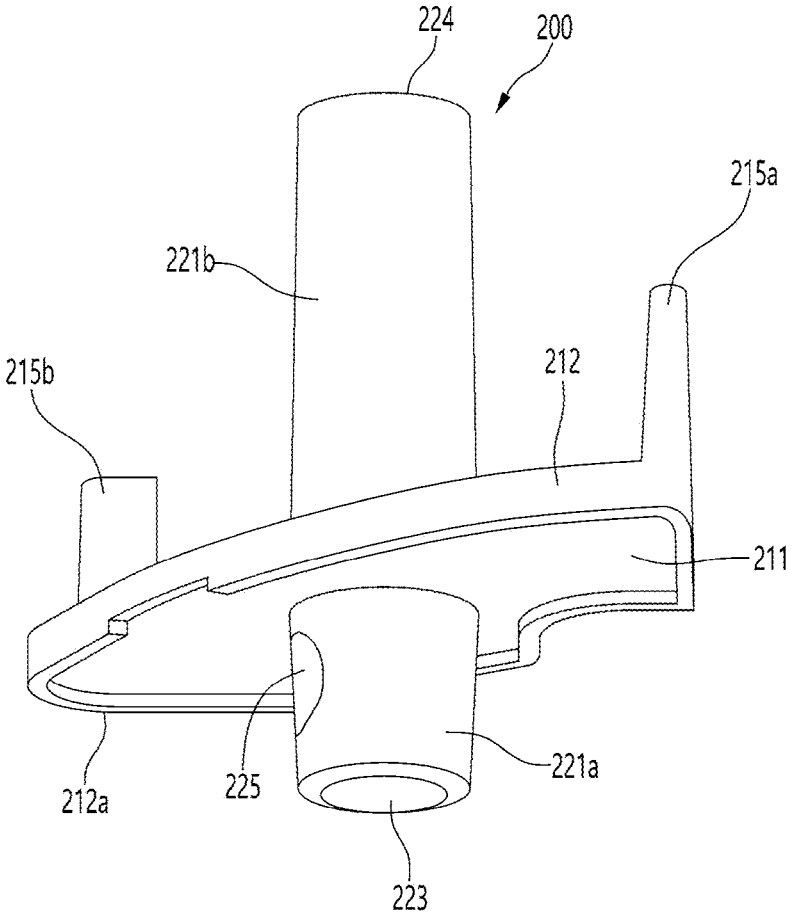
FIG. 9 is a lower perspective view illustrating the suction guide device.
Figure 10:
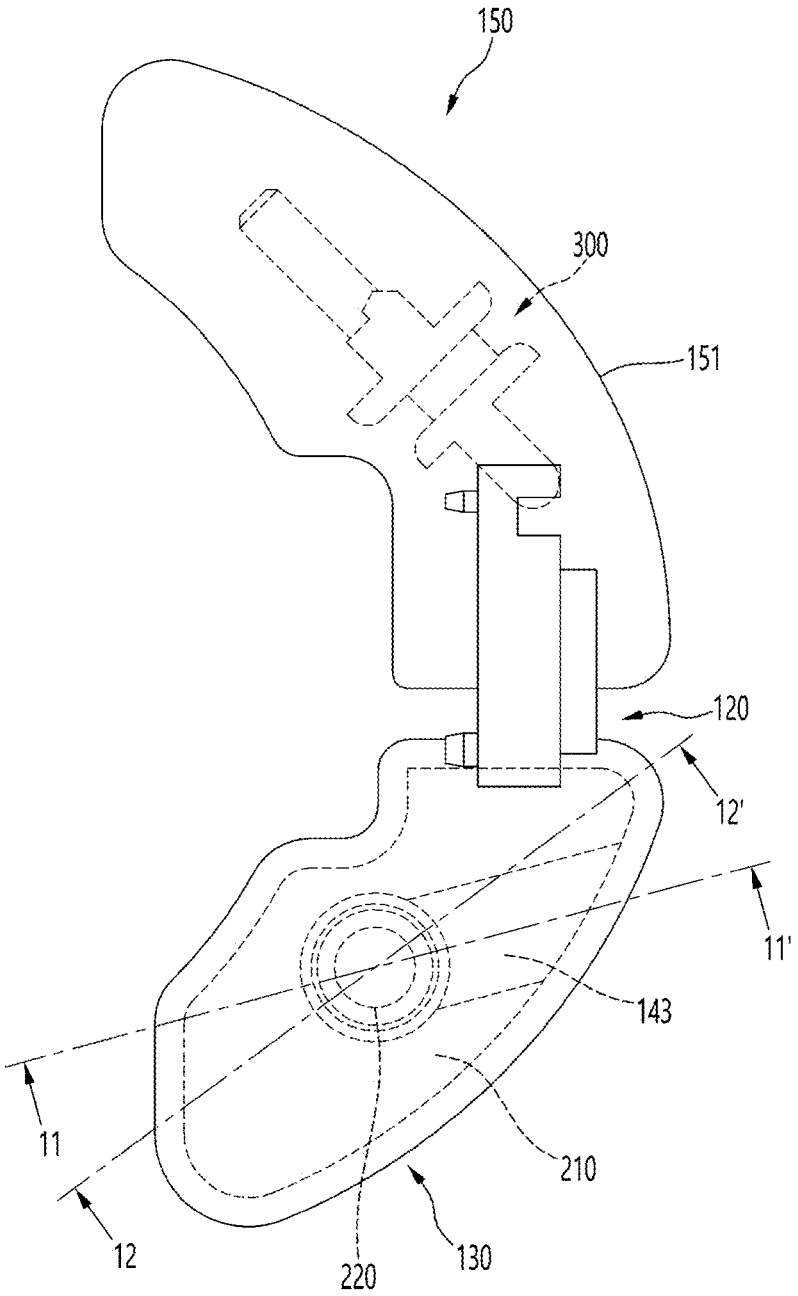
FIG. 10 is a plan view illustrating an example of a suction and discharge tank coupled to first and third muffler portions.
Figure 11:
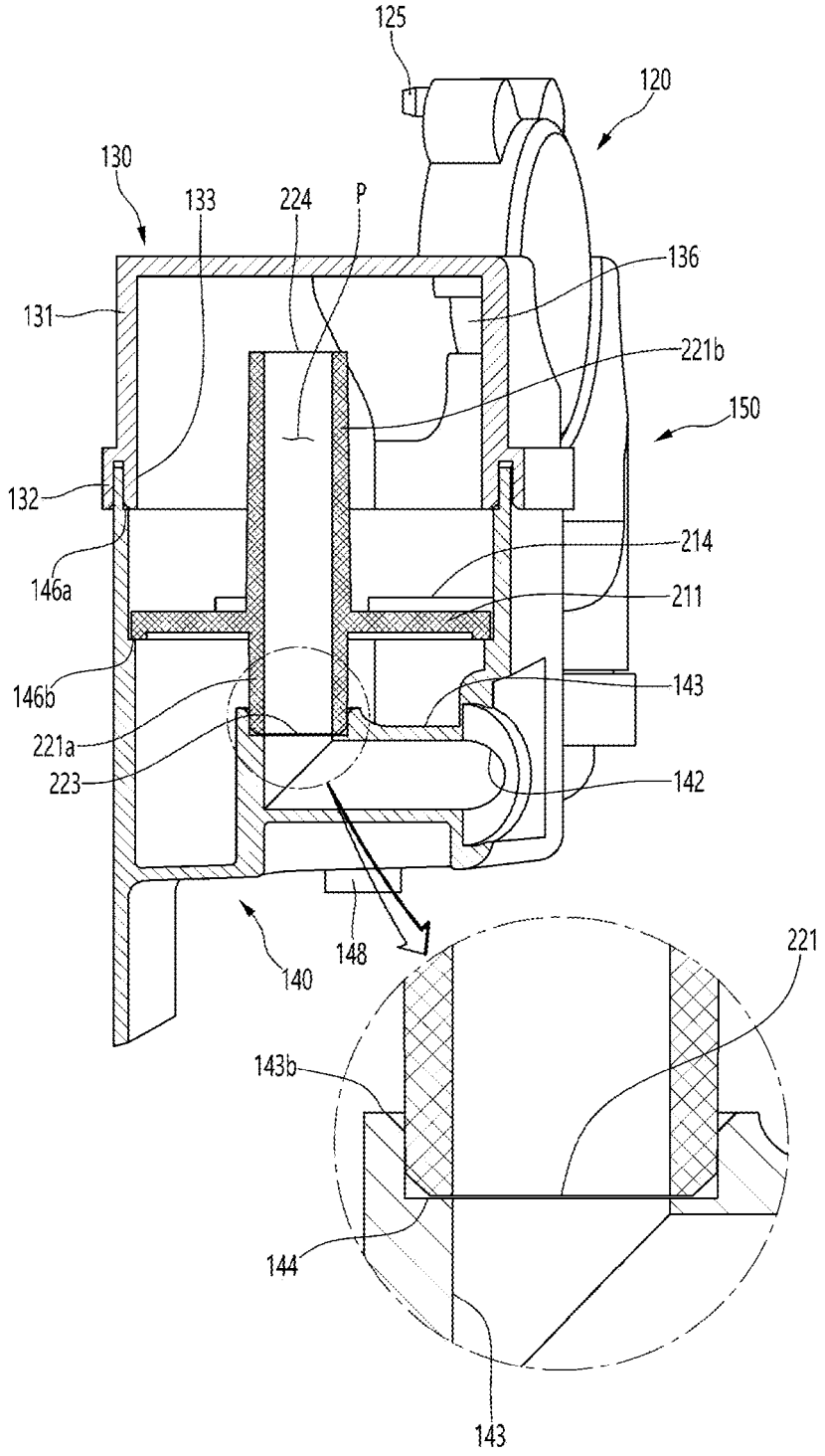
FIG. 11 is a cross-sectional view taken along line 11-11' of FIG. 10.
Figure 12:
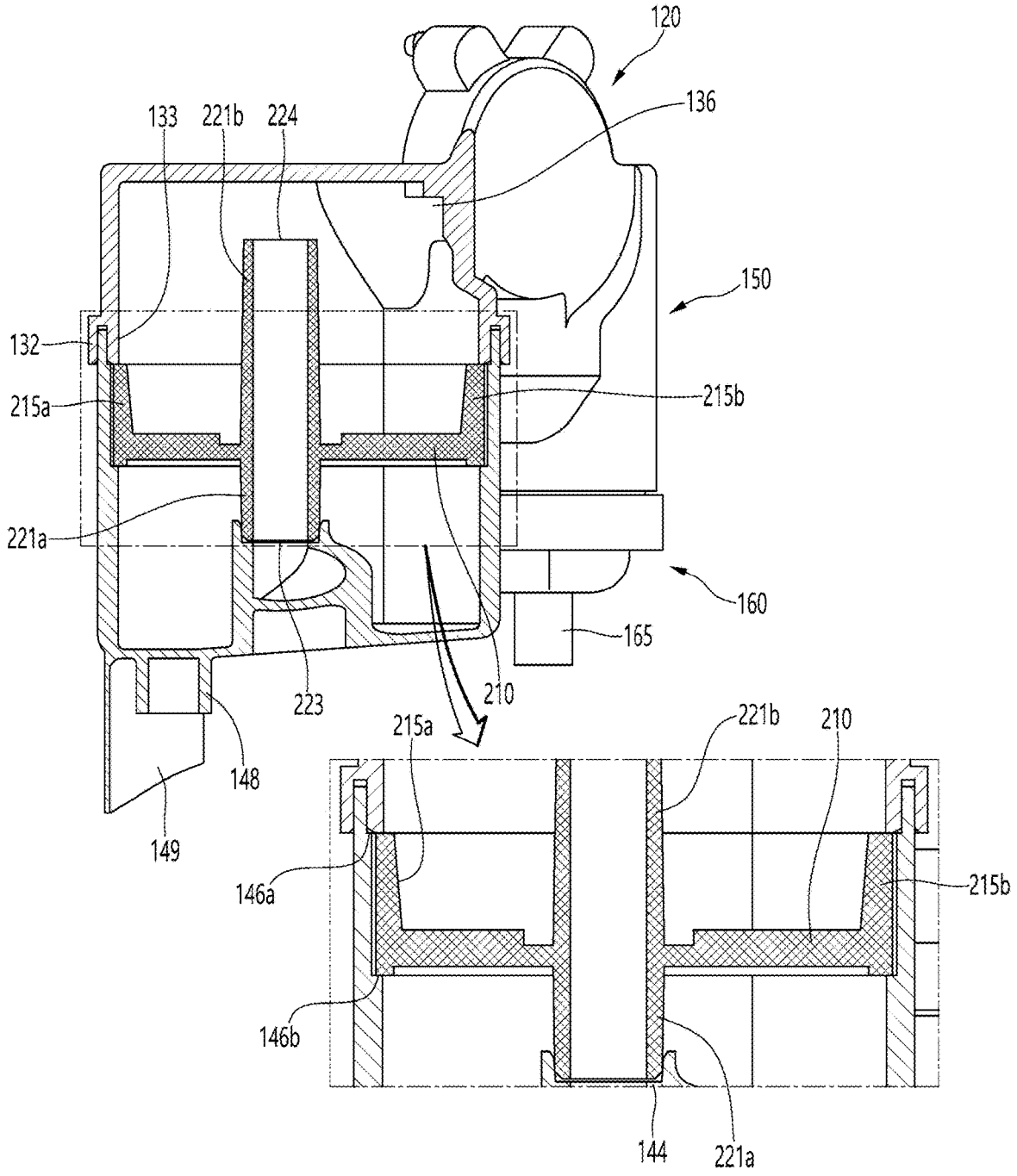
FIG. 12 is a cross-sectional view taken along line 12-12' of FIG. 10.

FIG. 8 is an upper perspective view illustrating an example configuration of the suction guide device, FIG. 9 is a lower perspective view illustrating an example configuration of the suction guide device, FIG. 10 is a plan view illustrating an example configuration of the suction and discharge tank that is integrated with the first and third muffler portions, FIG. 11 is a cross-sectional view taken along line 11-11' of FIG. 10, and FIG. 12 is a cross-sectional view taken along line 12-12' of FIG. 10.

Referring to FIGS. 8 to 12, the suction guide device 200 of the present disclosure can be provided inside the suction muffler portions 130 and 140. A flow space for the refrigerant can be defined in the suction guide device 200.

Figure 13:
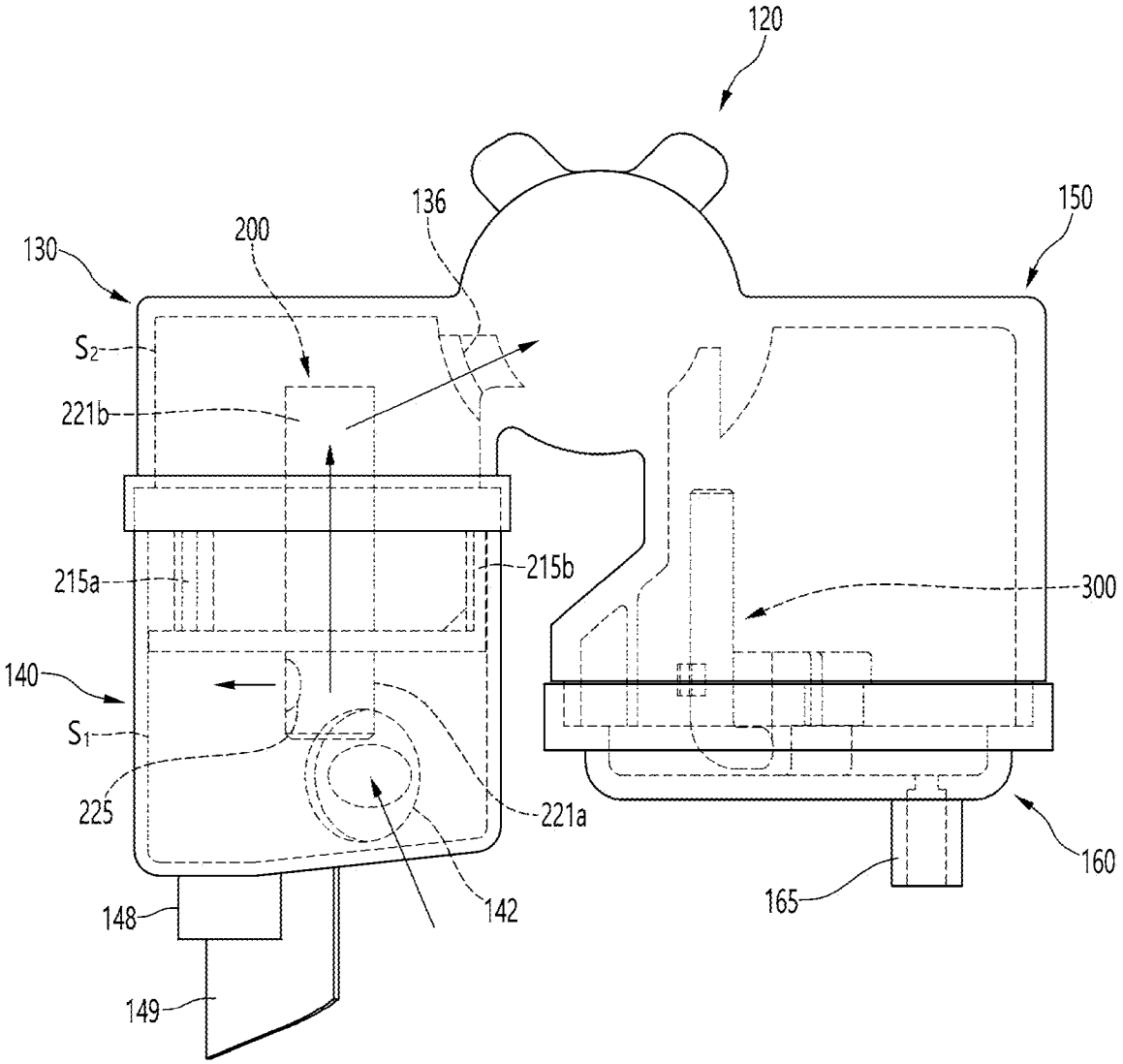
FIG. 13 is a view illustrating an example flow of refrigerant suctioned in a suction muffler.

The suction guide device 200 can include a partition wall 210 that divides the inner space of the suction muffler portions 130 and 140 into two spaces S1 and S2 (see FIG. 13). The partition wall 210 can include a partition wall plate 211 as a body portion having a shape corresponding to a cross-section of the inside of each of the suction muffler portions 130 and 140.

The two spaces S1 and S2 can include a first space S1 functioning as a resonance chamber (resonant silencer) and a second space S2 functioning as a cavity chamber (expandable silencer).

The partition wall plate 211 can include a plate body having a thin plate shape.

The partition wall plate 211 can include an edge portion 212 that is bent from an outer circumferential surface of the partition wall plate 211 to extend downward. The edge portion 212 can be provided to slightly protrude downward from the plate body of the partition wall plate 211.

The edge portion 212 can be supported on an inner circumferential surface of the second suction muffler portion 140. For example, the edge portion 212 can be in surface contact with the inner circumferential surface of the second suction muffler portion 140. The edge portion 212 can be referred to as a "support rib" of the partition wall.

A lower end 212*a* of the edge portion 212 can be supported by the second support jaw 146*b* of the second suction muffler portion 140. That is, an outer circumferential surface of the partition wall plate 211 can be supported by the inner circumferential surface of the second suction muffler portion 140, and an end of the partition wall plate 211 can be supported by the second support jaw 146*b*, and thus, supporting force of the suction guide device 200 with respect to the second suction muffler portion can increase.

The partition wall 210 can further include protrusions 215*a* and 215*b* protruding upward from a top surface of the partition wall plate 211.

A plurality of the protrusions 215*a* and 215*b* can be provided, and the plurality of protrusions 215*a* and 215*b* can be provided at both sides of the partition wall plate 211, respectively. For example, the protrusions 215*a* and 215*b* can include a first protrusion 215*a* provided at one side of the partition wall plate 211 and a second protrusion 215*b* provided at an opposite side of the partition wall plate 211.

The protrusions 215*a* and 215*b* can be supported on an inner circumferential surface of the second suction muffler portion 140. For example, the protrusions 215*a* and 215*b* can be in surface contact with the inner circumferential surface of the second suction muffler portion 140.

The protrusions 215*a* and 215*b* can be supported on the inner circumferential surface of the second suction muffler portion 140, which is disposed between the first supporting jaw 146*a* and the second supporting jaw 146*b*. That is, the protrusions 215*a* and 215*b* can be disposed upward from the second supporting jaw 146*b* to the first supporting jaw 146*a*.

Upper ends of the protrusions 215*a* and 215*b* can be pressed by a lower end of the first suction muffler portion 130 when the first and second suction muffler portions 130 and 140 are assembled. For example, the upper ends of the protrusions 215*a* and 215*b* can be disposed at substantially the same height as the first supporting jaw 146*a*, and the lower end of the first suction muffler portion 130 can be disposed on the upper ends of the first supporting jaws 146*a* and the protrusions 215*a* and 215*b*. Due to this configuration, the first and second suction muffler portions 130 and 140 and the suction guide device 200 can be easily and rigidly assembled.

The partition wall 210 can further include a reinforcing rib 214 provided on the partition wall plate 211. The reinforcing rib 214 can be provided to protrude from the top surface of the partition wall plate 211. The reinforcing rib 214 can extend from the top surface of the partition wall plate 211 in a direction that is directed from the first protrusion 215*a* to the second protrusion 215*b*.

The suction guide device 200 can further include a guide pipe 220 connected to the partition wall 210 and defining a flow space for the refrigerant.

The guide pipe 220 can extend in a direction crossing the partition wall 210.

For example, the partition wall 210 can extend in a horizontal direction inside the suction muffler portions 130 and 140 to divide the inner space into upper and lower first and second spaces S1 and S2.

The guide pipe 220 can extend to passing through the partition wall 210, and a refrigerant passage P can be defined in the guide pipe 220.

The guide pipe 220 can be provided in a longitudinal direction inside the suction muffler portions 130 and 140 to extend upward and downward from the partition wall 210.

The guide pipe 220 can include a pipe body 221 defining a flow space for the refrigerant therein. The pipe body 221 can include a first pipe portion 221*a* disposed in the first space S1 and a second pipe portion 221*b* disposed in the second space S2.

The first pipe portion 221*a* can extend downward from a bottom surface of the partition wall plate 211, and the second pipe portion 221*b* can extend upward from a top surface of the partition wall plate 211.

The second pipe portion 221*b* can be an element constituting the expandable silencer, and since a length of the second pipe portion 221*b* is capable of affecting performance of the silencer, the length of the second pipe portion 221*b* can be relatively long. Thus, the length of the second pipe portion 221*b* can be longer than that of the first pipe portion 221*a*.

The guide pipe 220 can extend in the vertical direction and include a first end 223 for introducing the refrigerant suctioned in the suction hole 142 and a second end 224 for discharging the refrigerant passing through the guide pipe 220 to the inner spaces of the suction muffler portions 130 and 140.

For example, the first end 223 can define the lower end of the guide pipe 220, and the second end 224 can define the upper end of the guide pipe 220.

The first end 223 can be disposed on the first pipe portion 221*a*, and the second end 224 can be disposed on the second pipe portion 221*b*.

The first pipe portion 221*a* can be disposed in the first space S1, that is, a resonance chamber. The second pipe portion 221*b* can be disposed in the second space S2, that is, a cavity chamber.

A through-hole 225 can be defined in the first pipe portion 221*a*. The through-hole 225 can be understood as a resonance hole. Noise generated during the operation of the compressor can be absorbed toward the first space S1 through the through-hole 225 to reduce the noise.

The through-hole 225 can be defined so that at least a portion of the outer circumferential surface of the first pipe portion 221*a* passes through the through-hole 25 between the inside and the outside.

An assembly process of the first and second suction muffler portions 130 and 140 and the suction guide device 200 will be briefly described.

First, the suction guide device 200 is mounted inside the second suction muffler portion 140. In some examples, a lower end of the guide pipe 220 can be inserted into the pipe discharge portion 143*b* of the suction pipe portion 143 and supported by the support stepwise portion 144.

The partition wall plate 211 of the partition wall 210 can be supported by the second support jaw 146*b* of the second suction muffler portion 140, and the protrusions 215*a* and 215*b* of the partition wall 210 can be supported on the inner circumferential surface of the second suction muffler portion 140.

Next, the first suction muffler portion 130 is assembled to one side of the second suction muffler portion 140. The assembly end 147 of the second suction muffler portion 140 can be inserted into the insertion space 134 between the inner wall 133 of the first suction muffler portion 130 and the first muffler flange 132.

In some implementations, a lower end of the first suction muffler portion 130, in particular, a lower end of the inner wall 133, can press the protrusions 215*a* and 215*b* of the suction guide device 200, and thus, the suction guide device 200 can be firmly fixed to the inside of the suction muffler portions 130 and 140.

FIG. 13 is a view illustrating an example flow of the refrigerant suctioned in the suction muffler. Referring to FIG. 13, an operation of the refrigerant suction in the suction muffler portions 130 and 140 will be briefly described.

When the reciprocating compressor 1 starts to operate, the refrigerant is introduced into a shell 10 through the suction pipe 12 and is introduced into the suction muffler portions 130 and 140 through the suction hole 142.

The refrigerant can be introduced into the second suction muffler portion 140 to flow through the suction pipe portion 143. The refrigerant is introduced into the first end 223 of the guide pipe 220 through the pipe discharge portion 143*b* to flow upward from the partition wall 210 along an extension direction of the guide pipe 220.

In some examples, a portion of the refrigerant can flow into the first space S1 through the through-hole 225, and the through-hole 225 can function as a resonance hole of the resonance chamber.

The refrigerant flowing through the guide pipe 220 can be discharged into the second space S2 through the second end 224. In some examples, the refrigerant can increase in flow cross-sectional area to reduce an occurrence of noise.

The refrigerant in the suction muffler portions 130 and 140 can be introduced into the suction and discharge tank 120 and then be suctioned into a compression space C of a cylinder 33 through a suction valve of the valve assembly.

Figure 14A:
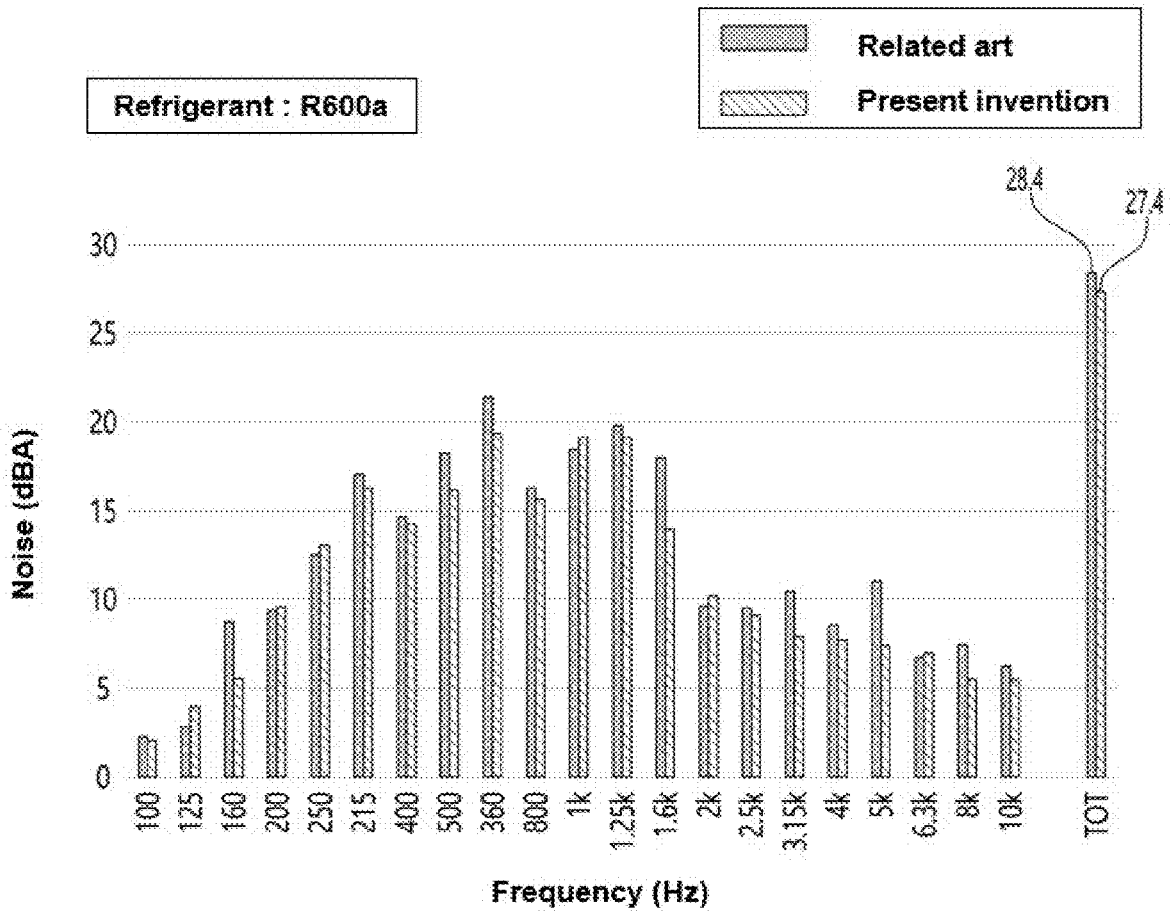
FIGS. 14A and 14B are experimental graphs illustrating a noise reduction effect in the suction muffler provided with the suction guide device.
Figure 14B:
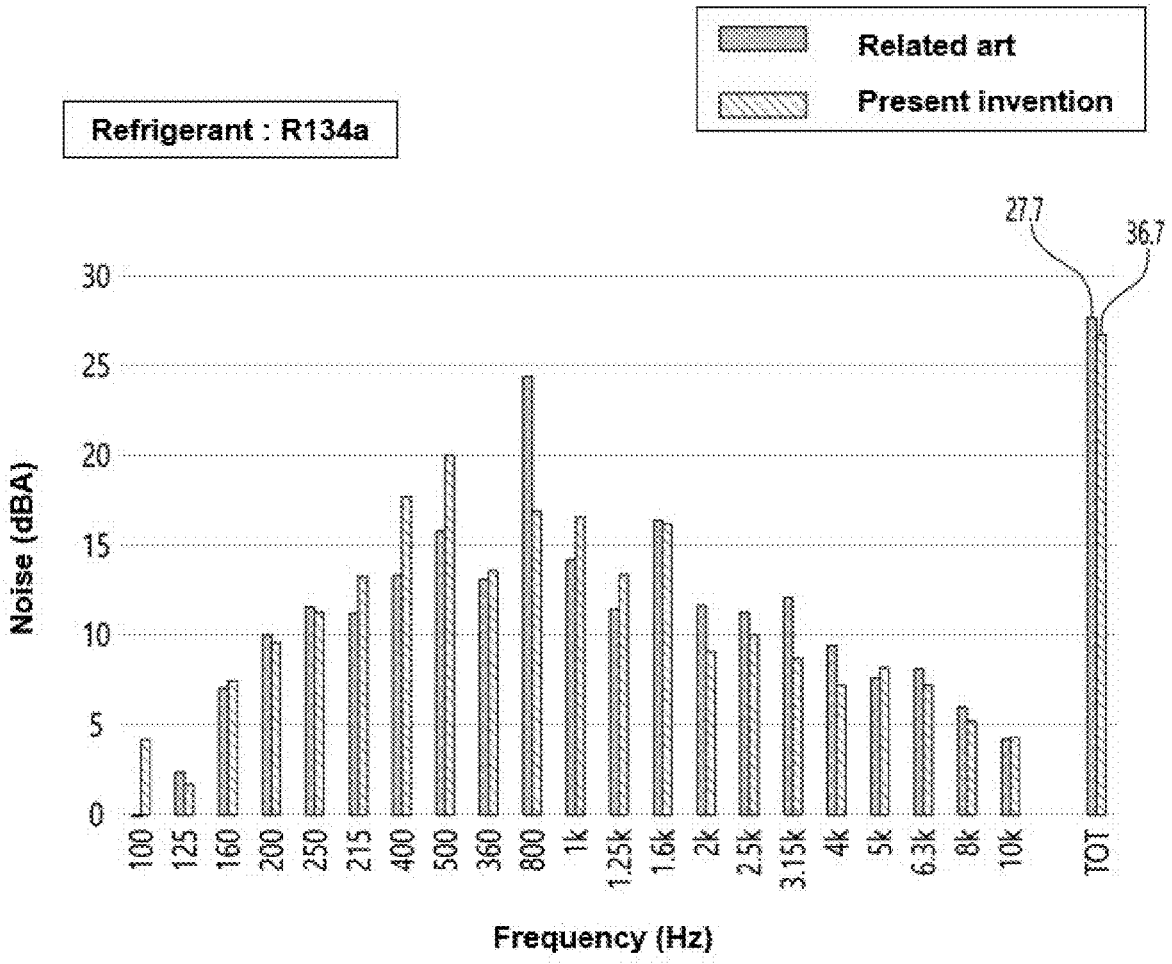

FIGS. 14A and 14B are experimental graphs illustrating an example of a noise reduction effect in the suction muffler provided with the suction guide device.

FIG. 14A is a graph illustrating an example of an intensity of noise generated in a frequency range of a specific band when a refrigerant used in the reciprocating compressor is R600a according to the related art and the present disclosure. The frequency range of the specific band represents a range of about 100 Hz to about 10 kHz.

The related art can be defined as a technique using a suction muffler without the suction guide device, and the present disclosure can be defined as a technique in which the suction guide device 200 described above is provided inside the suction muffler portions 130 and 140.

An intensity of noise generated in the suction muffler according to the present disclosure is less than that of noise generated by the suction muffler according to the related art, over the frequency range (about 100 Hz to about 10 kHz).

In some examples, noise (about 27.4 dBA) of the suction muffler according to the present disclosure is reduced by about 1 dBA than noise (28.4 dBA) of the suction muffler according to the related art.

FIG. 14B is a graph illustrating an example of an intensity of noise when a refrigerant used in the reciprocating compressor is R134a according to the related art and the present disclosure. Experimental conditions are the same as those described in FIG. 14A.

An intensity of noise generated in the suction muffler according to the present disclosure is less than that of noise generated by the suction muffler according to the related art, over the frequency range (about 100 Hz to about 10 kHz).

In some examples, noise (about 26.7 dBA) of the suction muffler according to the present disclosure can be reduced by about 1 dBA than noise (27.7 dBA) of the suction muffler according to the related art.

In some examples, the suction guide device can be provided inside the suction muffler according to the present disclosure to reduce the noise in the resonance chamber and the cavity chamber.

In some implementations, the muffler assembly having the resonance chamber can be provided to reduce the noise generated in the compressor.

In some implementations, the partition wall, which divides the inner space of the suction muffler into the two spaces, can be provided to reduce the noise.

In particular, the partition wall can be installed in the suction muffler to divide the inner space into the resonance chamber and the cavity chamber, and the partition wall can be stably supported on the inner surface of the suction muffler.

In some implementations, the guide pipe communicating with the suction hole of the suction muffler can be provided in the partition wall to easily guide the refrigerant from the first space to the second space.

In some implementations, the suction pipe portion extending from the suction hole to the guide pipe can be provided to easily transfer the refrigerant suctioned through the suction hole to the guide pipe.

In some implementations, the support structure for the guide pipe and the suction pipe portion can be provided to facilitate the assembly of the guide pipe and the suction pipe portion and allow the guide pipe to be stably supported on the suction pipe portion during the suction of the refrigerant.

In some implementations, the protrusion can be provided on the partition wall to allow the guide pipe to be stably supported on the suction muffler.

In some implementations, the through-hole (resonance hole) can be defined in the guide pipe to reduce the noise generated in the compressor.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A reciprocating compressor comprising:

a cylinder; and a suction muffler configured to receive refrigerant and to supply the refrigerant to the cylinder, the suction muffler comprising:

a suction muffler body that defines a suction space configured to receive the refrigerant, the suction muffler body further defining a suction hole, a suction pipe portion that is disposed inside the suction muffler body and extends from the suction hole, a partition wall that is disposed at the suction muffler body and partitions the suction space into a first space and a second space, and a guide pipe that is disposed at the partition wall and defines a refrigerant passage in fluid communication with the first and second spaces, the guide pipe being separably coupled to the suction pipe portion, wherein the guide pipe comprises:

a first pipe portion that extends from the partition wall to the first space and has a circumferential surface defining a resonance hole, the first pipe portion having a first end that is in fluid communication with the suction pipe portion and configured to introduce the refrigerant suctioned through the suction hole, and a second pipe portion that extends from the partition wall to the second space, the second pipe portion having a second end that is configured to discharge the refrigerant from the guide pipe to the second space, and wherein the suction pipe portion is in contact with the first end of the first pipe portion to thereby support the first pipe portion.

2. The reciprocating compressor according to claim 1, wherein the suction pipe portion extends from the suction hole to a central portion of the suction muffler body.

3. The reciprocating compressor according to claim 1, wherein the suction pipe portion comprises:

a pipe discharge portion configured to discharge the refrigerant in the suction pipe portion to the guide pipe; and a support stepwise portion that protrudes inward from an inner circumferential surface of the pipe discharge portion and supports the first end of the first pipe portion.

4. The reciprocating compressor according to claim 1, wherein the guide pipe extends from the first space to the second space in a direction crossing the partition wall.

5. The reciprocating compressor according to claim 1, wherein the guide pipe extends from the first space to the second space through the partition wall.

6. The reciprocating compressor according to claim 1, wherein a length of the second pipe portion is greater than a length of the first pipe portion.

7. The reciprocating compressor according to claim 1, wherein the partition wall comprises:

a partition wall plate connected to the guide pipe; and a protrusion that protrudes from the partition wall plate and is in contact with an inner surface of the suction muffler body, and wherein the suction muffler body comprises a support jaw that supports the partition wall plate.

8. The reciprocating compressor according to claim 7, wherein the suction muffler body comprises a first suction muffler body and a second suction muffler body, and wherein the partition wall plate is disposed within the second suction muffler body.

9. The reciprocating compressor according to claim 8, wherein an inner surface of the second suction muffler body supports the protrusion of the partition wall, and wherein an end of the first suction muffler body is configured to apply pressure to the protrusion of the partition wall.

10. The reciprocating compressor according to claim 9, wherein the first suction muffler body comprises a flange and an inner wall that are spaced apart from each other to thereby define an insertion space therebetween, the insertion space receiving an end of the second suction muffler body.

11. The reciprocating compressor according to claim 10, wherein the inner wall of the first suction muffler body is configured to apply pressure to the protrusion of the partition wall.

12. The reciprocating compressor according to claim 1, wherein the first space comprises a resonance chamber, and the second space comprises a cavity chamber, and wherein the resonance chamber and the cavity chamber are configured to reduce noise generated in the reciprocating compressor.

13. The reciprocating compressor according to claim 1, further comprising:

a tank disposed between the cylinder and the suction muffler and configured to receive the refrigerant from the suction muffler and to discharge the refrigerant to the cylinder; and a discharge muffler disposed at a side of the tank and configured to receive the refrigerant compressed in the cylinder and to discharge the refrigerant to an outside of the discharge muffler.

14. The reciprocating compressor according to claim 13, wherein the tank is disposed between the suction muffler and the discharge muffler and connects the suction muffler and the discharge muffler to each other.

15. The reciprocating compressor according to claim 13, wherein the refrigerant passage extends from the first end of the first pipe portion facing away from the tank to the second end of the second pipe portion facing the tank, and wherein a distance between the partition wall and the first end of the first pipe portion is less than a distance between the partition wall and the second end of the second pipe portion.

16. The reciprocating compressor according to claim 1, wherein the partition wall is disposed inside the suction muffler body.

17. The reciprocating compressor according to claim 1, wherein the refrigerant passage extends from the first end of the first pipe portion to the second end of the second pipe portion, and wherein each of the resonance hole and the first end of the first pipe portion is configured to supply the refrigerant in the first space to the second space through the refrigerant passage.

18. The reciprocating compressor according to claim 1, wherein the resonance hole passes through the circumferential surface of the first pipe portion and is in fluid communication with the refrigerant passage inside the first pipe portion.

19. A reciprocating compressor comprising:

a cylinder; and a suction muffler configured to receive refrigerant and to supply the refrigerant to the cylinder, the suction muffler comprising:

a suction muffler body that defines a suction space configured to receive the refrigerant, the suction muffler body further defining a suction hole, a suction pipe portion that is disposed inside the suction muffler body and extends from the suction hole, a partition wall that is disposed at the suction muffler body and partitions the suction space into a first space and a second space, and a guide pipe that is disposed at the partition wall and defines a refrigerant passage in fluid communication with the first and second spaces, wherein the guide pipe comprises:

a first pipe portion that extends from the partition wall to the first space and has a circumferential surface defining a resonance hole, the first pipe portion having a first end configured to introduce the refrigerant suctioned through the suction hole, and a second pipe portion that extends from the partition wall to the second space, the second pipe portion having a second end configured to discharge the refrigerant from the guide pipe to the second space, and wherein the suction pipe portion comprises:

a pipe discharge portion configured to discharge the refrigerant in the suction pipe portion to the guide pipe, and a support stepwise portion that protrudes inward from an inner circumferential surface of the pipe discharge portion and supports the first end of the first pipe portion.

20. The reciprocating compressor according to claim 19, wherein the support stepwise portion of the suction pipe portion is in contact with the first end of the first pipe portion.

* * * * *